US007918180B2

(12) United States Patent
Yajima et al.

(10) Patent No.: US 7,918,180 B2
(45) Date of Patent: Apr. 5, 2011

(54) FILM FORMING APPARATUS

(75) Inventors: Kentaroh Yajima, Yokohama (JP); Yasuomi Mikami, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 495 days.

(21) Appl. No.: 12/022,802

(22) Filed: Jan. 30, 2008

(65) Prior Publication Data

US 2008/0257258 A1 Oct. 23, 2008

(30) Foreign Application Priority Data

Jan. 31, 2007 (JP) ..... 2007-022194

(51) Int. Cl.
*B05B 3/00* (2006.01)
*B05B 13/02* (2006.01)

(52) U.S. Cl. ..... 118/323; 118/307; 118/325

(58) Field of Classification Search ..... 118/307, 118/323, 325, DIG. 11; 451/92; 134/175, 134/177, 199, 200
See application file for complete search history.

(56) References Cited

U.S. PATENT DOCUMENTS 1,911,124 A * 5/1933 Linder et al. ..... 118/404
4,130,084 A * 12/1978 Hoelen ..... 118/59

FOREIGN PATENT DOCUMENTS

| | | |
|---|---|---|
| JP | 2-31863 | 2/1990 |
| JP | 2004-97896 | 4/2004 |
| JP | 2004-290853 | 10/2004 |
| JP | 2004-322026 | 11/2004 |
| JP | 2007-14879 | 1/2007 |
| JP | 2007-44626 | 2/2007 |

* cited by examiner

*Primary Examiner* — Yewebdar T Tadesse
(74) *Attorney, Agent, or Firm* — Cooper & Dunham LLP

(57) ABSTRACT

A film forming apparatus to form a coating film by applying a coating material to an outer circumferential surface of a cylindrical object to be coated, includes a material applying device having a nozzle unit to apply the coating material to the outer circumferential surface of the object and a material supplying unit to supply the coating material to the nozzle unit and a moving device configured to move the nozzle unit relatively to the object such that the coating material is applied uniformly to the outer circumferential surface of the object. The moving device includes an object holding unit configured to hold the object, a nozzle moving unit configured to move relatively the nozzle unit with respect to the object holding unit along a longitudinal axis of the object holding unit, and a guide unit configured to guide the nozzle unit along the object holding unit as the nozzle unit moves along the object holding unit such that an interval between the nozzle unit and the object is maintained constant.

13 Claims, 9 Drawing Sheets

FILM FORMING APPARATUS

CROSS REFERENCE TO RELATED APPLICATIONS

The present application is based on and claims priority from Japanese Application Number 2007-022194, filed on 31, Jan. 2007, the disclosure of which is hereby incorporated by reference herein in its entirety.

BACKGROUND

1. Technical Field

This disclosure relates to a film forming apparatus which forms a coating film by applying a coating material to an outer circumferential surface of a cylindrical object which is formed in an endless belt form. More particularly, the disclosure relates to a film forming apparatus appropriately used for forming an elastic layer of a fixing member such as a fixing roller, a fixing belt, or the like, which fixes an unfixed toner image on a transfer paper by heating and pressurizing the toner image in an image forming apparatus employing an electronic photographic system such as a PPC (a plain paper copier), an LBP (a laser beam printer), a facsimile, or the like.

2. Description of the Related Art

An image forming apparatus such as a copying machine, a printer, or the like, which are based on the principle of electrophotography, performs a fixing process in which a transfer paper is pressed and toner is melted by heat to be fixed on the transfer paper. Recently, in order to improve image grain, an elastic layer, which is made of heat-resistant rubber such as silicon rubber and is formed at a thickness of 100 to 300 μm is formed on a fixing member such as a fixing roller or a fixing belt used in the fixing process so that the fixing member presses the transfer paper with even pressure. The elastic layer is required to have even thickness because variation of the thickness of the elastic layer affects the fixed image and a setup time (time until a predetermined temperature is reached) of the fixing member (fixing roller) based on variation of thermal conductivity of the silicon rubber.

The above-described fixing roller or fixing belt is obtained for example as follows. A primer (an adhesive) is applied on a substrate as an object to be coated (a cylindrical cored bar made of metal such as aluminum or iron, or a belt-shaped substrate made of polyimide, Ni, or the like) and a coating material including heat-resistant rubber such as silicon rubber is applied to form an elastic layer having approximately a thickness of 100 to 300 μm. Then, as mentioned above, the fixing roller or fixing belt can be obtained.

In order to form the above-described elastic layer, various kinds of film forming apparatuses, for example, in a spray coating system or a dipping system where the thickness of the elastic layer as the coating film is controlled by changing viscosity of the coating material are used. In order to change the viscosity of the coating material, the coating material is required to be diluted with solvent. Accordingly, it is not preferable to use the above-described film forming apparatus because use of the solvent cause environmental loads.

Furthermore, the Applicant of the present invention has proposed a film forming apparatus which forms the coating film without diluting the coating material with the solvent, for example a film forming apparatus using a ring coating method (see for example, Japanese Patent Publication No. 2007-14879). The film forming apparatus disclosed in Japanese Patent Publication No. 2007-14879 forms the coating film as follows. The substrate is positioned in a state where an axis of the substrate is disposed parallel to a vertical direction, the substrate is inserted in an annular nozzle unit, and the coating material is applied from an inner circumferential surface of the nozzle unit to an outer circumferential surface of the substrate while the nozzle unit is moved along the axis of the substrate. By use of this type of the film forming apparatus, since only an amount of the coating material to be attached to the substrate is needed, the coating material is not required to be diluted with the solvent.

However, in the film forming apparatus disclosed in Japanese Patent Publication No, 2007-14879, if the substrate is made of polyimide and formed in an endless-belt form, the substrate as the object to be coated is required to be held in an accurately perfect circular form and an interval between the inner circumferential surface of the nozzle unit and the outer circumferential surface of the substrate is required to be maintained constant.

In the film forming apparatus disclosed in Japanese Patent Publication No. 2007-14879, a mandrel as an object supporting device is fitted in the substrate or holds the substrate in a static pressure system. However, desirable accuracy is not achieved by use of the film forming apparatus disclosed in Japanese Patent Publication No. 2007-14879 and in order to form the thin elastic layer at an even thickness, it is necessary to hold the substrate in a more accurately perfect circular form. That is to say, it is difficult to form the elastic layer having even thickness by the above-described film forming apparatus.

On the other hand, it is necessary that an applied pressure of the coating material from the nozzle unit be accurately maintained constant as well as the inner circumferential surface of the nozzle unit being accurately positioned with respect to the outer circumferential surface of the substrate. For example, when the film forming apparatus forms the elastic layer of a thickness approximately between a few μm and 30 μm, the interval between the outer circumferential surface of the substrate and the inner circumferential surface of the nozzle unit must be maintained constant even if the nozzle unit is positioned at any positions in a direction of the axis of the mandrel.

BRIEF SUMMARY

In an aspect of this disclosure, there is provided a film forming apparatus in which wherever the nozzle unit is positioned in the direction of the axis of the object supporting device, the interval between the outer circumferential surface of the object and the inner circumferential surface of the nozzle unit can be maintained constant.

In another aspect, a film forming apparatus is configured to form a coating film by applying a coating material to an outer circumferential surface of a cylindrical object to be coated, and includes a material applying device having a nozzle unit to apply the coating material to the outer circumferential surface of the object and a material supplying unit to supply the coating material to the nozzle unit and a moving device configured to move the nozzle unit relatively to the object such that the coating material is applied uniformly to the outer circumferential surface of the object. The moving device includes an object holding unit configured to hold the object, a nozzle moving unit configured to move relatively the nozzle unit with respect to the object holding unit along a longitudinal axis of the object holding unit, and a guide unit configured to guide the nozzle unit along the object holding unit as the nozzle unit moves along the object holding unit such that an interval between the nozzle unit and the object. is maintained constant.

DETAILED DESCRIPTION OF THE PREFERRED EMBODIMENTS

Figure 1:
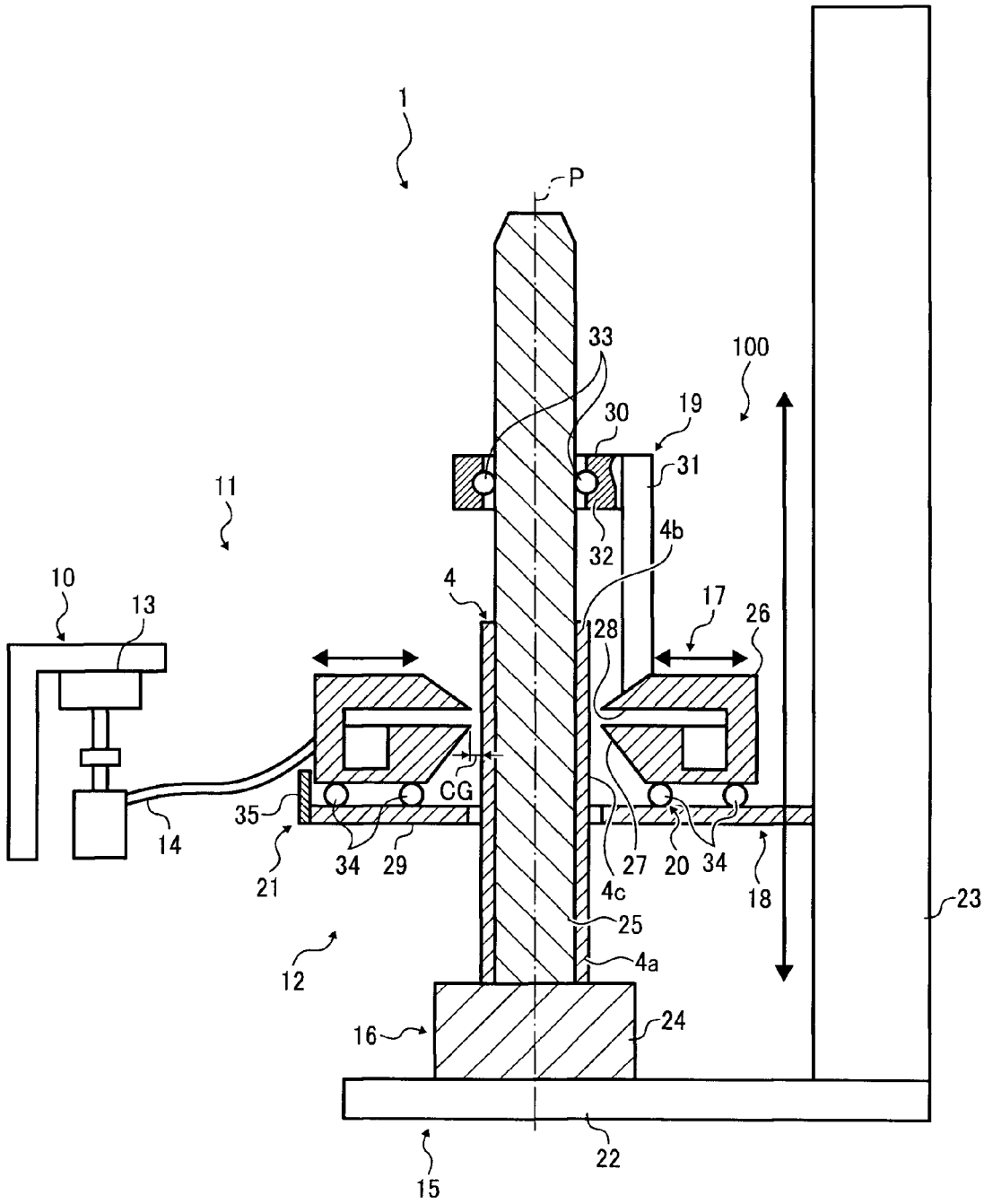
FIG. 1 is an explanatory view illustrating a schematic configuration of a film forming apparatus according to a first embodiment of the present invention.
Figure 2:
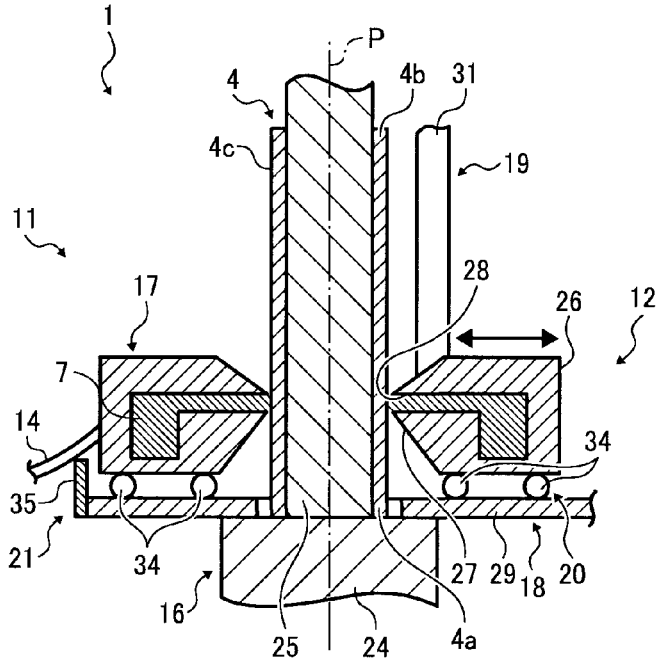
FIG. 2 is an explanatory view illustrating a state where the film forming apparatus shown in FIG. 1 starts to apply a coating material.
Figure 3:
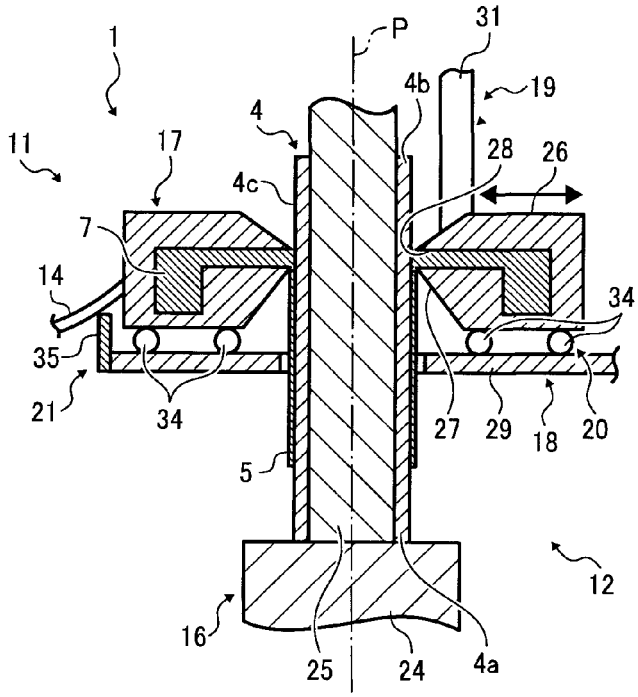
FIG. 3 is an explanatory view illustrating a state where the film forming apparatus shown in FIG. 1 completes the application.

A film forming apparatus to form a coating film, for example an elastic layer 5 by applying a coating material to an outer circumferential surface of a cylindrical object to be coated according to each of embodiments of the present invention will be described below. A film forming apparatus 1 according to a first embodiment of the present invention will be described with reference to FIGS. 1 to 3. FIG. 1 is an explanatory view illustrating a configuration of the film forming apparatus 1 according to the first embodiment of the present invention. The film forming apparatus 1 according to the first embodiment of the present invention includes a material applying device 11 having a nozzle unit 17 to applying a coating material 7 to an outer circumferential surface 4*c* of a substrate 4 as the cylindrical object and a material supplying unit 10 to supply the coating material 7 to the nozzle unit 17 and a moving device 12 configured to move the nozzle unit 17 relatively to the substrate 4 such that the coating material 7 is applied uniformly to the outer circumferential surface 4*c* of the substrate. The moving device includes an object holding unit such as a mandrel 25 configured to hold the substrate 4, a nozzle moving unit 18 configured to move relatively the nozzle unit 17 with respect to the mandrel 25 along a longitudinal axis of the mandrel 25, and a guide unit 100 configured to guide the nozzle unit 17 along the mandrel 25 such that an interval between the nozzle unit 17 and the substrate is maintained constant as the nozzle unit 17 moves along the mandrel 25. FIG. 2 is a sectional view of the nozzle unit 17 of the film forming apparatus 1 shown in FIG. 1 when starting to apply the coating material 7. FIG. 3 is a sectional view of the nozzle unit 17 of the film forming apparatus 1 shown in FIG. 1 when the application of the coating material 7 is completed.

On the substrate 4, for example, a primer layer 3 (see FIG. 13) of a fixing belt 2 (see FIG. 12) used in an image forming apparatus such as a copying machine is formed.

Figure 12:
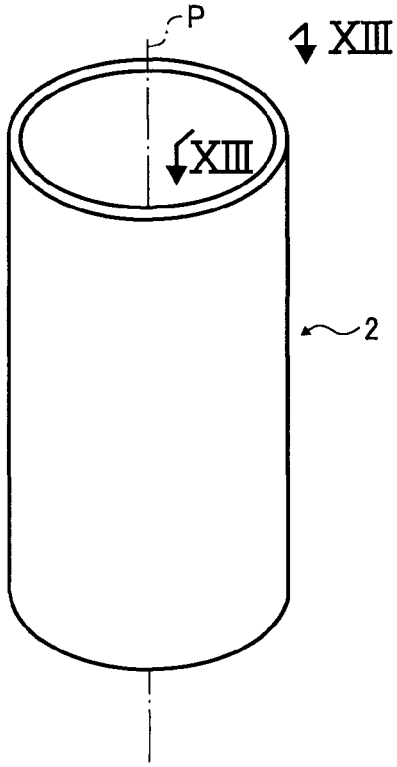
FIG. 12 is a perspective view illustrating a fixing belt on which a coating film is formed by the film forming apparatus according to an embodiment of the present invention.
Figure 13:
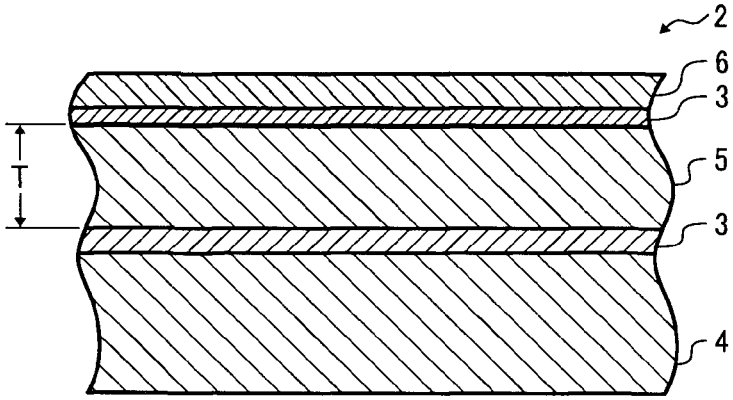
FIG. 13 is a sectional view along XIII-XIII line in FIG. 12

The fixing belt 2 is elastically deformable and is formed in an endless belt form, as shown in FIG. 12. The fixing belt 2 is formed, as shown in FIG. 13, by laminating for example, the substrate 4 formed in an endless belt form, which is made of a synthetic resin such as polyimide, a primer layer (adhesive layer) 3, the elastic layer 5 formed of a heat-resistant rubber such as silicon rubber, a primer layer (adhesive layer) 3, and a separation layer 6 formed of fluorine resin, in order. The elastic layer 5 is formed, for example, in a thickness T of about 100 to 800 μm.

The elastic layer 5 is formed from an end portion 4*a* to another end portion 4*b* of the substrate 4 in a width direction of the substrate 4. Here, the end portions 4*a* and 4*b* correspond to a lower end portion and an upper end portion when a coating material 7 (described later) is applied by the film forming apparatus 1, respectively. The above-described fixing belt 2 is heated and presses a toner on a transfer paper to fix the toner on the transfer paper.

The film forming apparatus 1 forms the above-described elastic layer 5 by applying the coating material including the above-described silicon rubber, a known medium, and the like on the outer circumferential surface 4*c* of the substrate 4 having a surface on which the primer layer (adhesive layer) 3 is formed. That is to say, the film forming apparatus 1 applies the coating material 7 to the primer layer (adhesive layer) 3. The viscosity of the coating material 7 is sufficiently larger than the viscosity of a coating material used for forming the above-described primer layer 3 or the separation layer 6.

As shown in FIG. 1, the film forming apparatus 1 also includes a control device (not shown). The material supplying unit 10 includes a cylinder pump 13 disposed, for example, on a floor of an industrial plant, a tube 14, and the like. The tube 14 connects the cylinder pump 13 and a nozzle body 26 (described later) of the nozzle unit 17. The cylinder pump 13 supplies the aforementioned coating material 7 to an inside of the nozzle body 26 of the nozzle unit 17 through the tube 14.

The moving device 12 has an object supporting device 16 including the aforementioned mandrel 25. The film forming apparatus 1 also includes, as shown in FIG. 1, a main body 15 and a switching unit 21. The main body 15 includes a base 22 disposed on a floor of the industrial plant, and an extending plate 23 extending upwardly from the base 22. The guide unit 100 includes a nozzle guiding portion 19 which is fixed on the nozzle unit 17 and movably disposed with respect to the mandrel 25 along the direction of the axis P of the mandrel 25 and a nozzle carrying portion 20 configured to carry and movably support the nozzle unit 17 with respect to the nozzle moving unit 18 in a direction perpendicular to the axis P of the mandrel.

The object supporting device 16 includes a base 24 and the mandrel 25 as an object holding portion. The base 24 is formed in a cubic form and disposed on the base 22 of the main body 15. The mandrel 25 is formed in a cylindrical form and disposed so as to extend upwardly from an upper surface of the base 24. The mandrel 25 is fixed on the base 22. An axis of the mandrel is parallel to a vertical direction. A length of the mandrel 25 is for example generally twice a width of the substrate 4.

The mandrel 25 is inserted into the substrate 4 and holds the substrate 4. When the mandrel 25 holds the substrate 4, an outer surface of the mandrel 25 is for example attached firmly to an inner surface of the substrate 4. Because the longitudinal axis P of the mandrel 25 also serves as an axis of the substrate 4, when the mandrel 25 holds the substrate 4, the axis P (shown as a dashed line in FIG. 1) of the substrate 4 becomes parallel to the vertical direction and the outer circumferential surface 4*c* of the substrate 4 is formed in a cylindrical form having a circular section viewed in a direction perpendicular to the axis. As described above, the mandrel 25, that is to say, the object supporting device 16 holds the substrate 4 in a state where the axis P of the substrate 4 is parallel to the vertical direction.

The nozzle unit 17 includes, as shown in FIG. 1, the nozzle body 26 formed in an annular form having a hollow center. The nozzle body 26 is formed of a magnetic body. The coating material 7 is supplied from the material supplying unit 10 to an inside of the nozzle body 26. The nozzle body 26 is disposed in a coaxial state with the mandrel 25 and the substrate 4 held by the mandrel 25 and is movably disposed through the nozzle moving unit 18. An inner diameter of the nozzle body 26 is larger than an outer diameter of the substrate 4 held by the mandrel 25. That is to say, the inner circumferential surface 27 of the nozzle body 26 is disposed to face the outer circumferential surface 4*c* of the substrate 4 with an interval CG, and to have a same axis as that of the substrate 4 held by the object supporting device 16. The thickness T of the elastic layer 5 to be formed is about 60 to 75 percent of the interval CG.

The inner circumferential surface 27 of the nozzle body 26 is extended inwardly in a tapered shape and is provided with a slit 28 to communicate an outside and an inside of the nozzle body 26. The slit is formed entirely on the inner circumferential surface 27 of the nozzle body 26, that is to say, the nozzle unit 17. The tapered inner circumferential surface 27 of the nozzle body 26 has a top portion at which the slit 28 is opened. The nozzle body 26 applies the coating material 7 supplied from the material supplying unit 10 to the outer circumferential surface 4*c* of the substrate 4 held by the mandrel 25 of the object supporting device 16 through the slit 28. The nozzle unit 17 can form the elastic layer 5 at a predetermined thickness T on the outer circumferential surface 4*c* of the substrate 4 due to the interval CG.

The nozzle moving unit 18 includes a base member 29, a linear guide, a motor, a linear encoder, and the like. The base member 29 is formed in an annular form and the nozzle unit 17 is disposed on a surface of the base member 29. The mandrel 25 is inserted into the base member 29 and the base member 29 is disposed on the base 22. The linear guide movably supports the base member 29, that is to say, the nozzle unit 17 along the vertical direction. The motor is used for moving the base member 29 (the nozzle unit 17) along the vertical direction. That is to say, the motor moves up and down the base member 29 (the nozzle unit 17).

The linear encoder detects a position of the base member 29, that is to say, the nozzle unit 17. The linear encoder outputs the detected position of the base member 29 (the nozzle unit 17) to the control device. Accordingly, the nozzle moving unit 18 moves the nozzle unit 17 relatively to the substrate held by the mandrel 25 along the axis P of the substrate 4 by moving up and down the base member 29.

The nozzle guiding portion 19 of the guide unit 100 includes a guide member 30 and a connecting member 31. The guide member 30 includes an annular guide body 32 and rollers 33 as rolling elements, which are rollably disposed on an inner circumferential surface of the guide body 32. An inner diameter of the guide body 32 is larger than an outer diameter of the mandrel 25. The mandrel 25 is inserted in the guide body 32.

Each of the rollers 33 contacts firmly with the outer circumferential surface of the mandrel 25 which is inserted in the guide body 32. That is to say, each of the rollers 33 is disposed so as not to allow the guide body 32 to jounce. Each of the rollers 33 is rollably disposed on the outer circumferential surface of the mandrel 25 along the axis P. The rollers 33 allow the guide body 32, that is to say the guide member 30 to move along the axis P of the mandrel 25 and the substrate 4 held by the mandrel 25 by rolling on the outer circumferential surface of the mandrel 25.

The connecting member 31 is formed in, for example, a columnar form and is disposed so as to allow a longitudinal direction of the connecting member 31 to be parallel to the axis P. The connecting member 31 is fixed on both of the nozzle body 26 of the nozzle unit 17 and the guide member 30. That is to say, the guide member 30 of the nozzle guiding portion 19 is fixed on the nozzle body 26 of the nozzle unit 17.

Since the rollers 33 contact closely on the outer circumferential surface of the mandrel 25, relative movement of the guide member 30, that is to say, the nozzle guiding portion 19 with respect to the mandrel 25 of the object supporting device 16 in a direction crossing the axis P, for example, in the direction perpendicular to the axis P is controlled or limited. That is to say, relative movement of the guide member 30 (the nozzle guiding portion 19) with respect to the mandrel 25 is controlled or limited in a direction crossing the axis P. Since the rollers 33 are disposed rollably in the direction of the axis P on the outer circumferential surface of the mandrel 25, the guide member 30 (the nozzle guiding portion 19) is movably disposed with respect to the mandrel 25 of the object supporting device 16 along the axis P.

The nozzle carrying portion 20 includes a plurality of rollers 34 disposed between the base member 29 and the nozzle body 26 of the nozzle unit 17. The plurality of rollers 34 are rollably disposed with respect to both of the base member 29 and the nozzle body 26 of the nozzle unit 17. Since the rollers 34 roll with respect to both of the base member 29 and the nozzle body 26 of the nozzle unit 17, the nozzle carrying portion 20 supports the nozzle body 26 of the nozzle unit 17 movably along the direction crossing the axis P (in the illustrated example, the direction perpendicular to the axis P).

Since the nozzle body 26 of the nozzle unit 17 is movably disposed along the direction crossing the axis P through the aforementioned nozzle carrying portion 20 and the nozzle body 26 is fixed on the guide member 30, the nozzle body 26 moves along the direction crossing the axis P with respect to the base member 29 by following the movement of the guide member 30 along the axis P on the outer circumferential surface of the mandrel 25. Accordingly, the nozzle unit 17 can apply the coating material 7 on the outer circumferential surface 4*c* of the substrate held by the mandrel 25 while the mandrel 25 and the nozzle unit 17 are maintained accurately in a coaxial state due to the nozzle carrying portion 20 and the nozzle guiding portion 19.

The switching unit 21 is provided on the base member 29 and includes a plurality of electromagnets 35. Each of the electromagnets 35 is disposed on an outer edge and is disposed with an interval to each other in a circumferential direction of the base member 29. In the illustrated example, two electromagnets 35 are provided with an interval of 90 degrees in the circumferential direction of the base member 29 to each other. Each of the electromagnets 35 generates a magnetic force when being energized so that the nozzle body 26 is adsorbed on the electromagnets 35 to fix the nozzle body 26 on the base member 29. When the electromagnets 35 are not energized, each of the electromagnets 35 does not adsorb the nozzle body 26 and allows the nozzle body 26 to move with respect to the base member 29.

The switching unit 21 is configured to switch, for example between two states of the nozzle body 26, that is to say, a state where movement of the nozzle body 26 with respect to the base member 29 is allowed and another state where the movement of the nozzle body 26 with respect to the base member 29 is limited or controlled, depending on whether or not the electromagnets 35 are energized. When the nozzle body 26 is adsorbed to the electromagnets 35, the switching unit 21 allows the nozzle body 26 to be fixed at a position where the axis of the nozzle body 26 is the same as that of a top portion (an upper end portion) of the mandrel 25.

The control device is a computer having known components such as a RAM, a ROM, a CPU, and the like. The control device connects the material supplying unit 10 and the material applying device 11 and controls them to control the film forming apparatus 1.

The film forming apparatus 1 having aforementioned configurations forms the elastic layer 5 on the outer circumferential surface of the substrate 4 as follows. At first, the mandrel 25 is inserted in the substrate 4 to be coated to set the substrate 4 on the mandrel 25. The film forming apparatus 1 is then activated and the control device controls the film forming apparatus 1 to allow the nozzle unit 17 and the guide member 30 of the nozzle guiding portion 19 to be moved down to an application starting position by moving down the nozzle moving unit 18. The control device controls the film forming apparatus 1 to allow the nozzle moving unit 18 to move up the nozzle unit 17 and the cylinder pump 13 to feed the coating material 7 at a constant rate through the tube 14 to the nozzle body 26 of the nozzle unit 17 in synchronism with a start of the moving up of the nozzle unit 17. Accordingly the application of the coating material 7 is started as shown in FIG. 2.

While the nozzle unit 17 is moved-up through the aforementioned nozzle moving unit 18, the guide member 30 moves along the axis P of the mandrel 25. At this time, since the mandrel 25 and the guide member 30 are fixed with respect to the guide member 30 and the nozzle body 26 of the nozzle unit 17 in the direction crossing the axis P (in the illustrated example, the direction perpendicular to the axis P), respectively, the mandrel 25 and the nozzle unit 17 are mutually positioned in the direction crossing the axis P (in the illustrated example, the direction perpendicular to the axis P). Since the nozzle body 26 moves on the base member 29 with low friction through the rollers 34 while the nozzle body 26 and the mandrel 25 are maintained in the coaxial state, the nozzle body 26 and the mandrel 25 can smoothly move in the coaxial state so that the application of the coating material 7 with constant accuracy of the interval CG can be achieved. As shown in FIG. 3, after the nozzle unit 17 moves at a vicinity of the upper end portion 4*b* of the substrate 4, the control device controls the film forming apparatus 1 to allow the cylinder pump 13 to stop the supply of the coating material 7. In addition, the control device controls the film forming apparatus 1 to allow the nozzle unit 17 to move up and when the base member 29 is removed from the mandrel 25, and the electromagnets 35 to be energized so that the nozzle body 26 is adsorbed to the electromagnets 35. Accordingly, the nozzle body 26 is fixed at a position where the nozzle body 26 does not interfere with the substrate 4 as the object to be coated. The film forming apparatus 1 then stops.

After that, the substrate 4 on which the coating film, that is to say, the elastic layer 6 is formed is removed from the mandrel 25 by an operator, or the like and the substrate 4 on which the coating film (elastic layer) 5 is not still formed is set on the mandrel 25 to form the coating film (elastic layer) 5 through the aforementioned processes.

As described above, the aforementioned control device controls the film forming apparatus 1 to allow the coating material 7 to be applied through the slit 28 of the nozzle unit 17, which faces the lower end portion 4*a* of the substrate 4 held by the mandrel 25 of the object supporting device 16. The control device also controls the nozzle moving unit 18 and the material supplying unit 10 such that the nozzle unit 17 moves toward the upper end portion 4*b* of the substrate 4 while applying the coating material 7 through the slit 28.

According to this embodiment, in the film forming apparatus 1 which is used for forming the elastic layer 5 as the coating film on the outer circumferential surface 4*c* of the substrate 4 as the object to be coated, the nozzle guiding portion 19 is fixed on the nozzle unit 17, which supplies the coating material 7 from an outside of the circumferential direction on the outer circumferential surface 4*c* of the substrate 4. The movement of the nozzle guiding portion 19 with respect to the object supporting device 16 in the direction crossing the axis P is controlled and the nozzle guiding portion 19 is disposed movably along the axis P with respect to the mandrel 25. Therefore, even if the nozzle unit 17 moves with respect to the object supporting device 16, the nozzle unit 17 follows the movement of the object supporting device 16 through the nozzle guiding portion 19 and then moves in the direction crossing the axis P of the mandrel 25. When the nozzle unit 17 moves along the axis P with respect to the object supporting device 16, the object supporting device 16 and the nozzle unit 17 can be maintained in the coaxial state. Accordingly, even if the nozzle unit 17 is positioned at any position in the direction of the axis P, the interval CG between the outer circumferential surface 4*c* of the substrate 4 and the inner circumferential surface 27 of the nozzle unit 17 can be firmly maintained to be constant so that the elastic layer 5, that is to say, the coating film can be advantageously formed with the constant thickness.

Furthermore, since the film forming apparatus 1 includes the switching unit 21 which switches the states where the nozzle unit 17 is fixed or movably disposed on the base member 29, the nozzle unit 17 can be fixed on the base member 29 after and before the application. Therefore, even if the nozzle guiding portion 19 is removed from the object supporting device 16 when the substrate 4 is removed from the object supporting device 16, the nozzle guiding portion 19 can be installed without interfering with the nozzle unit 17 for a next application.

Next, the film forming apparatus 1 according to a second embodiment of the present invention will be explained with reference to FIG. 4. The same reference numbers are used for the same structures as those of the first embodiment, and explanations about them are omitted.

Figure 4:
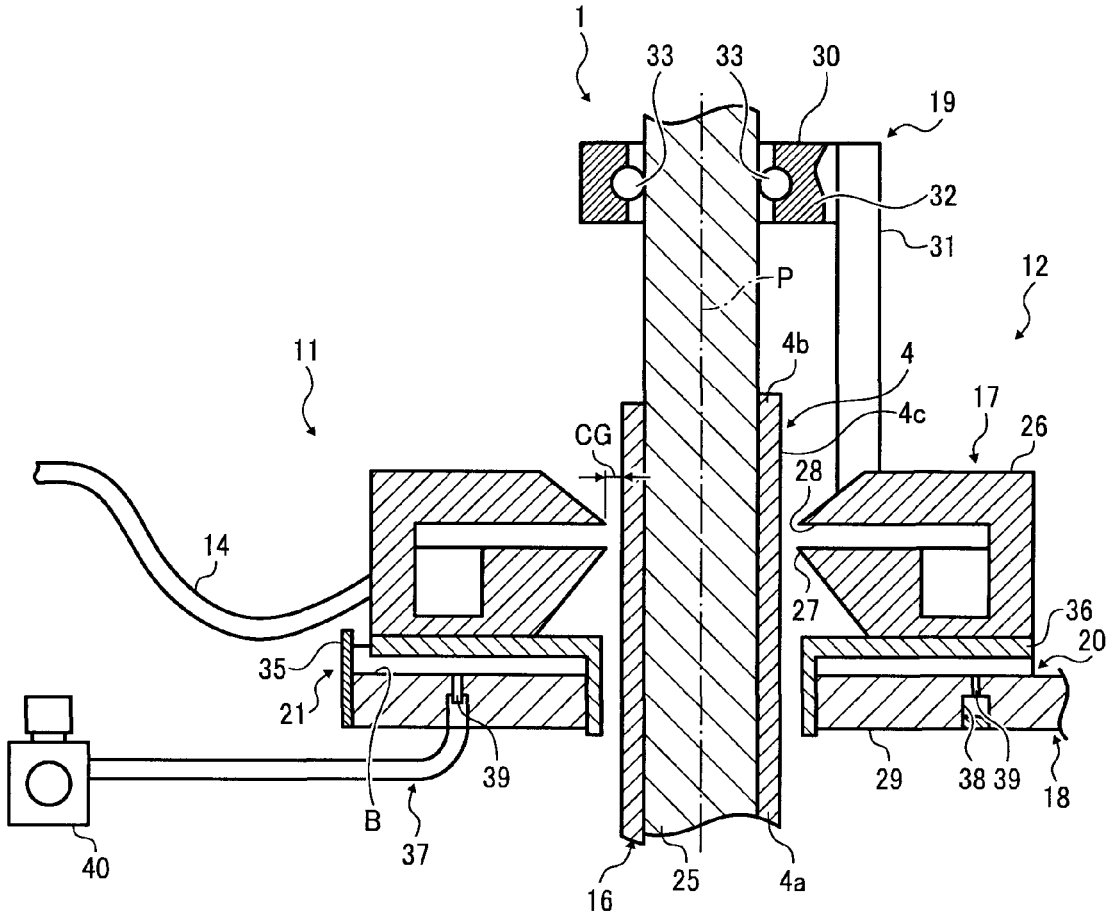
FIG. 4 is an explanatory view illustrating a configuration of a main part of the film forming apparatus according to a second embodiment of the present invention.

In this embodiment, as shown in FIG. 4, the nozzle unit 17 includes a nozzle base 36 in addition to the nozzle body 26. The nozzle base 36 is formed in an annular form having a finished base end surface and is disposed between the base member 29 and the nozzle body 26. The nozzle base 26 is provided at a position where the nozzle base 36 and the nozzle body 26 are in a coaxial state, and is fixed on the nozzle body 26. An inner diameter of the nozzle base 36 is larger than the outer diameter of the mandrel 25. The mandrel 25 is inserted in the nozzle base 36.

In this embodiment, the nozzle carrying portion 20 of the film forming apparatus 1 has a first pressurized gas supplier 37 to supply pressurized gas instead of the aforementioned rollers 34. The first pressurized gas supplier 37 includes a ring-shaped groove 38, fine orifices 39, a supply source of the pressurized gas (not shown), and a regulator 40. The ring-shaped groove 38 is provided in the base member 29 and is formed in a ring-shaped form. The ring-shaped groove 38 is provided in a coaxial state with the base member 29. The ring-shaped groove 38 is connected to the regulator 40 via a tube.

Each of the fine orifices 39 is provided with intervals to each other in a circumferential direction of the base member 29, and is opened at both sides of the ring-shaped groove 38 and an upper surface of the base member 29. The regulator 40 adjusts a pressure of the pressurized gas supplied from the supply source to an inside of the ring-shaped groove 38.

The aforementioned first pressurized gas supplier 37 sends the pressurized gas supplied from the supply source and the regulator 40 between the base member 29 and the nozzle base 36 of the nozzle unit 17 through the fine orifices 39 so that a thin air film B is formed between the base member 29 and the nozzle base 36. The first pressurized gas supplier 37 as the nozzle carrying portion 20 enables the nozzle unit 17 to be carried and supported movably along the direction crossing the axis P (in the illustrated example, the direction perpendicular to the axis P) by the thin air film B with respect to the base member 29.

In this embodiment, the rigidity of the thin air film B against a load to the thin air film B is preferably large in order to move the nozzle unit accurately in the direction crossing the axis P (perpendicular to the axis P). In a case that the outer diameter of the substrate 4 is 60 mm, the load to the thin air film B is 20 kg, and the inner and outer diameters of the nozzle base 36 are 70 mm and 140 mm, respectively, eight fine orifices 39 each of which has a diameter of 0.6 mm and is formed together with the base member 29 in a narrowed state with respect to the ring-shaped groove 38 are provided on a circumference portion of the base member 29. When the supplied pressure of the pressurized gas is 0.07 MPa (gage pressure), a thickness of the thin air film B is 30 μm and the rigidity is more than $1.0\times10^3$ kg/mm so that sufficient rigidity can be achieved. Under this condition, when performing the application, the pressurized gas is supplied from the regulator 40 while the nozzle unit is moved upwardly by the nozzle moving unit 18. Thereby, the nozzle unit 17 can be imperceptibly moved with respect to the base member 29 by the formed thin air film B in a highly low frictional state.

According to this embodiment, since the nozzle carrying portion 20 includes the first pressurized gas supplier 37 which supplies the pressurized gas between the base member 29 and the nozzle unit 17, the thin air film B formed of the pressurized air is formed between the nozzle unit 17 and the base member 29. Accordingly, since the nozzle unit 17 does not directly contact with the base member 29, the nozzle unit 17 is prevented from being worn and can smoothly move in the direction crossing the axis P of the mandrel 25 of the object supporting device 16. In addition, the aforementioned thin air film B formed of the pressurized air and provided between the nozzle unit 17 and the base member 29 serves a function of removing oscillation generated when the nozzle unit 17 moves along the axis P. Thereby, unevenness of the elastic layer 5 as the coating film is prevented from occurring so that surface quality of the elastic layer 5 can be improved.

Next, the film forming apparatus 1 according to a third embodiment of the present invention will be explained with reference to FIGS. 5 and 6. The same reference numbers are used for the same structures as those of the first and second embodiments and explanations about them are omitted.

Figure 5:
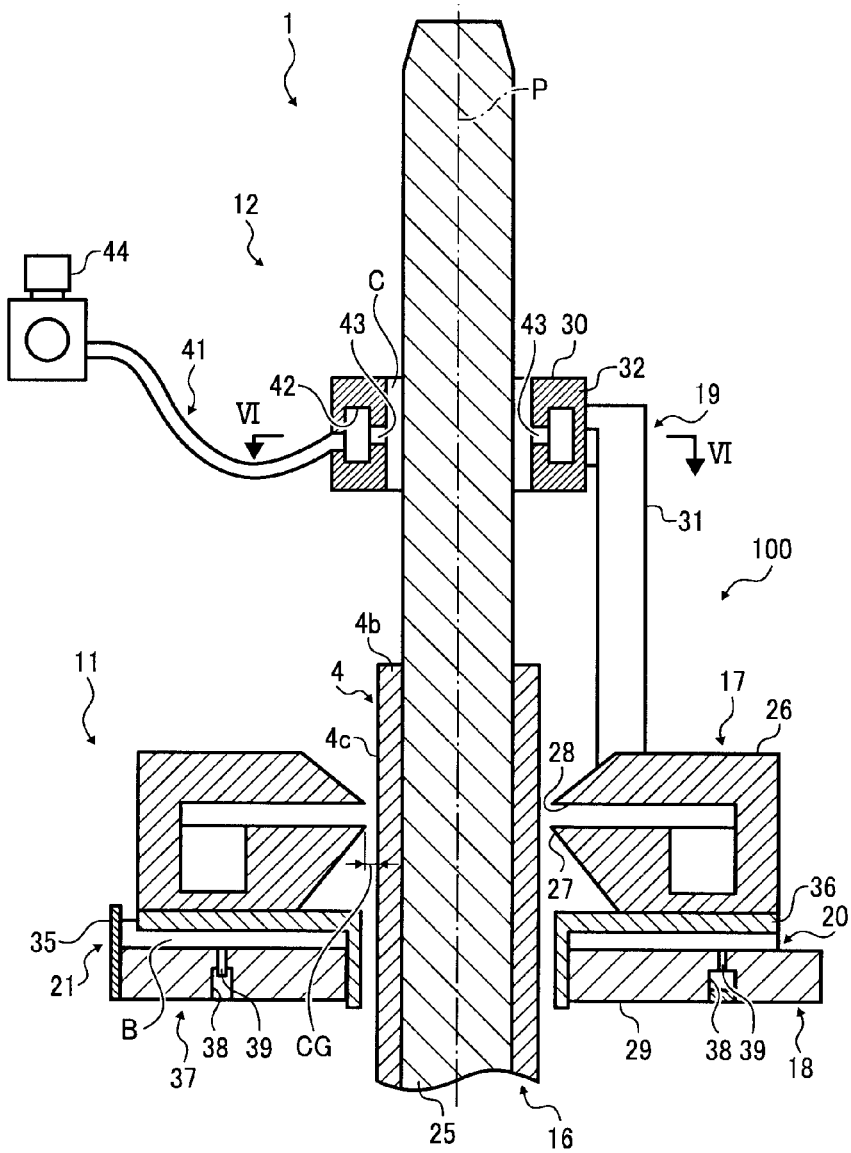
FIG. 5 is an explanatory view illustrating a configuration of a main part of the film forming apparatus according to a third embodiment of the present invention.
Figure 6:
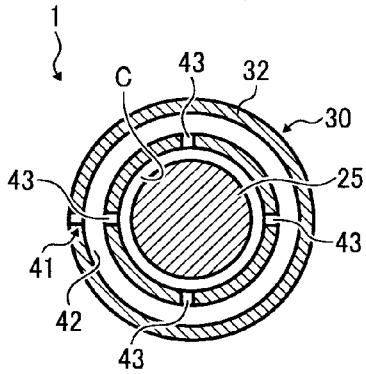
FIG. 6 is a sectional view along VI-VI line in FIG. 5

In this embodiment, as shown in FIGS. 5 and 6, the guide unit 100 of the film forming apparatus 1 includes a second pressurized gas supplier 41 in addition to the aforementioned first pressurized gas supplier 37.

The second pressurized gas supplier 41 includes a ring-shaped space 42, orifices 43, a supply source (not shown), and a regulator 44. The ring-shaped space 42 is provided in the guide body 32 of the guide member 30 and formed in a ring-like shape. The ring-shaped space 42 is provided in a coaxial state with the guide body 32 of the guide member 30. The ring-shaped space is connected to the regulator 44 via a tube.

Each of the orifices 43 is formed to have a diameter of 1 mm or less, and disposed with an interval to each other in a circumferential direction of the guide member 30. Each of the orifices 43 is opened at both sides of the ring-shaped space 42 and the inner circumferential surface of the guide body 32 of the guide member 30. In the illustrated example, four orifices 43 are provided at even intervals in the circumferential direction. The second pressurized gas supplier 41 includes preferably four or more orifices 43, more preferably, four, eight, or twelve orifices 43. In addition, although the orifices 43 are provided only in a line in the direction of the axis P, the orifices in one or more lines in the direction of the axis P can be provided. The regulator 44 adjusts the pressure of the pressurized gas supplied from the supply source to the ring-shaped space 42.

The aforementioned second pressurized gas supplier 41 sends the pressurized gas supplied from the supply source and the regulator 44 between the inner circumferential surface of the guide body 32 and the outer circumferential surface of the mandrel through the orifices 43 provided at even intervals in the circumferential direction in the application process. Thereby, a thin air film C of the pressurized gas is formed between the inner circumferential surface of the guide body 32 and the outer circumferential surface of the mandrel 25. By use of the second pressurized gas supplier 41 as the nozzle carrying portion 20, the thin air film C formed by the pressurized air from the orifices 43 gives rigidity between the guide member 30 and the mandrel 25 so that the guide body 32 and the nozzle unit 17 can follow a form of the mandrel 25 in the highly low frictional state while keeping a positional relationship between the guide member 30 and the mandrel 25 constant. As described above, in this embodiment, even if a space is formed between the inner circumferential surface of the guide body 32 and the outer circumferential surface of the mandrel 25, the second pressurized gas supplier 41 sends the pressurized gas therebetween to form the thin air film C so that the movement of the guide member 30 in the direction crossing the axis P with respect to the mandrel 25 is controlled or limited. Thereby, the mandrel 25, that is to say the substrate 4 and the nozzle unit 17 can be accurately disposed in a coaxial state when the application process is performed. In a case of the structure shown in FIG. 5, since there is no friction in the direction perpendicular to the axis P, load which affects the movement of the guide member 30 is not generated. The space with a thickness of 10 to 50 μm is disposed between the guide member 30 and the mandrel 25 so as to adjust the supplied pressure in a range between 0.02 and 0.07 MPa by the regulator 44.

In this embodiment, the guide unit 100 of the film forming apparatus 1 includes the second pressurized gas supplier 41 which supplies the pressurized gas between the inner circumferential surface of the guide member 30 and the outer circumferential surface of the mandrel 25 and then the thin sir film C of the pressurized gas is formed between the guide member 30 and the mandrel 25. Accordingly, when the nozzle unit 17 moves, the nozzle unit 17 can be prevented from directly contacting with the mandrel 25 so that the nozzle unit 17 and the object supporting device 16 are prevented from being worn to achieve longer lasting of the film forming apparatus 1.

Next, the film forming apparatus 1 according to a fourth embodiment of the present invention will be explained with respect to FIG. 7. Same reference numbers are used for the same structures as those of the first, second and third embodiments and explanations about them are omitted.

Figure 7:
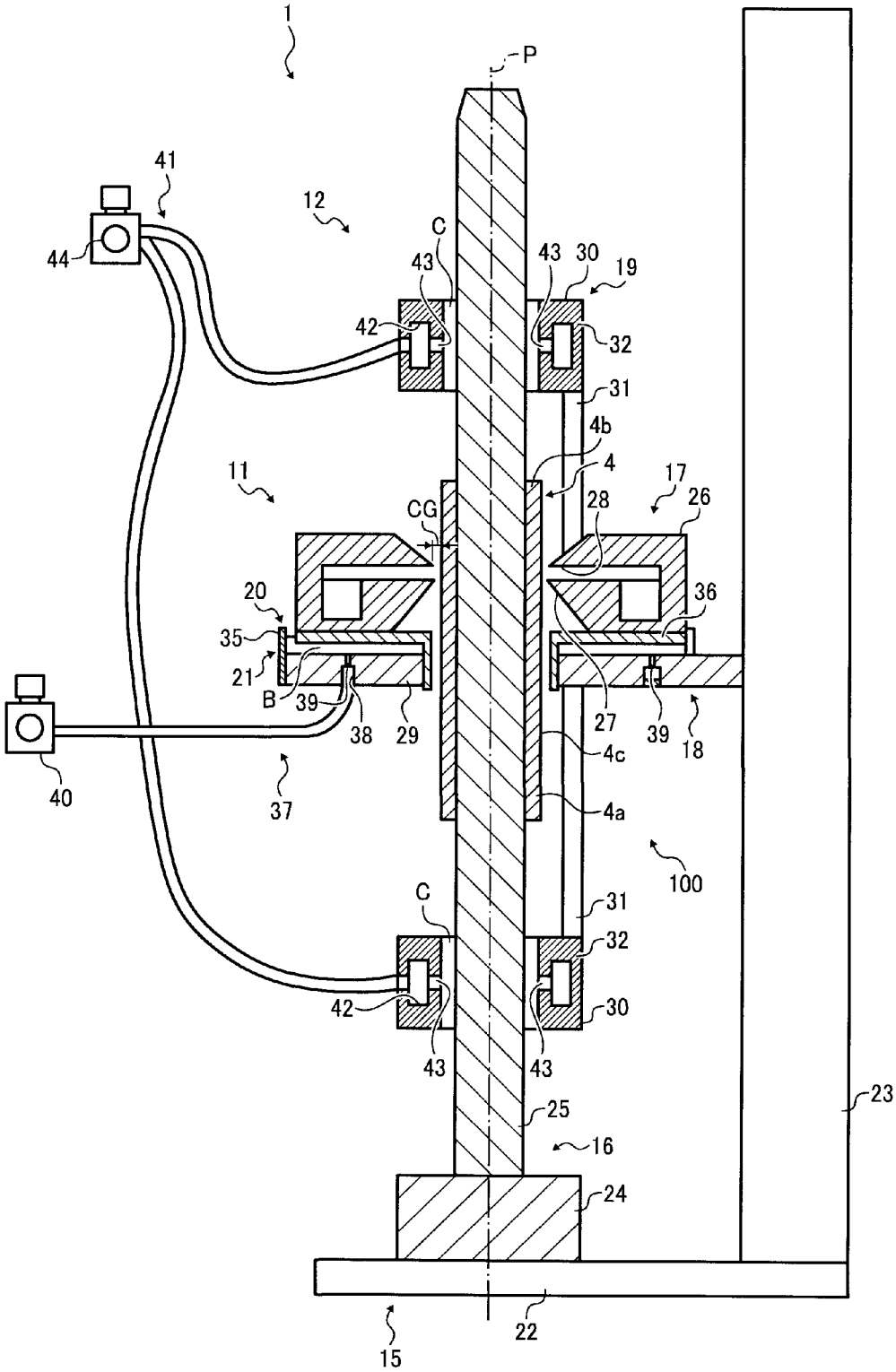
FIG. 7 is an explanatory view illustrating a schematic configuration of the film forming apparatus according to a fourth embodiment of the present invention.

In this embodiment, as shown in FIG. 7, the guide unit 100 has two guide members 30 and two connecting members 31.

In this embodiment, the mandrel 25 is three times or more in length than the substrate 4 and each of the aforementioned two guide members 30 is provided across the substrate 4 from each other. In this embodiment, when the application process, the nozzle unit 17 can be inclined so as to follow an imperceptible inclination of the mandrel 25 by each of the guide members 30. Therefore, the mandrel 25, that is to sat, the substrate 4 and the nozzle unit 17 are maintained accurately in a coaxial state and the coating material 7 can be constantly applied to the outer circumferential surface of the mandrel from a direction perpendicular to the outer circumferential surface of the substrate 4.

According to this embodiment, since plural guide members 30 are provided with intervals to each other along the axis P of the mandrel 25, the object supporting device 16 and the nozzle unit 17 can be more firmly maintained in a coaxial state so that the coating film can be firmly formed at an even thickness. In addition, it is possible for the film forming apparatus 1 to include three or more guide members 30.

Next, the film forming apparatus 1 according to a fifth embodiment of the present invention will be explained with reference to FIG. 8. The same reference numbers are used for the same structures as those of the first, second, third, and fourth embodiments and explanations about them are omitted.

Figure 8:
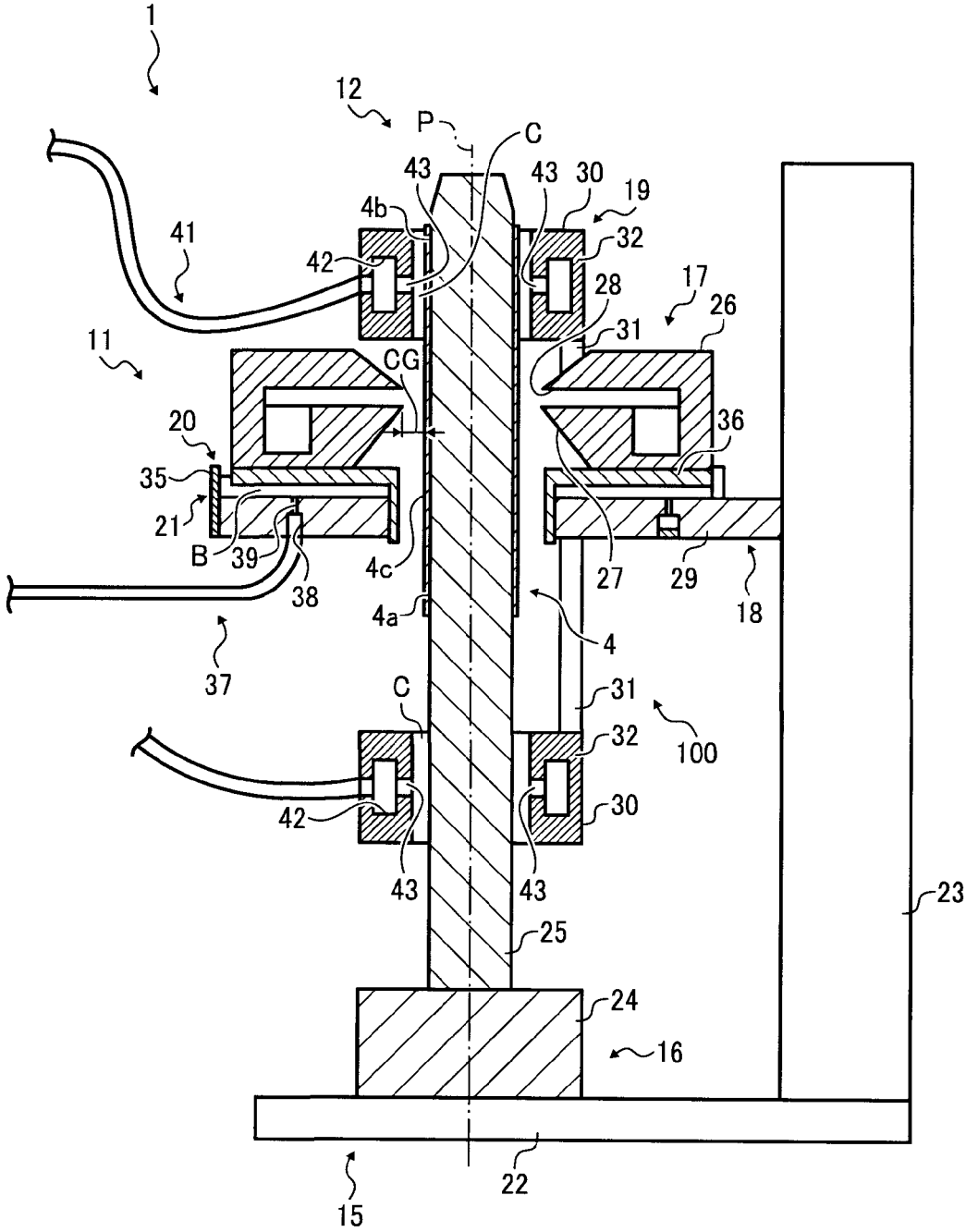
FIG. 8 is an explanatory view illustrating a schematic configuration of the film forming apparatus according to a fifth embodiment of the present invention.

In this embodiment, as shown in FIG. 8, when the nozzle unit 17 is moved by the nozzle moving unit 18, the inner circumferential surface of the guide member 30 is disposed to face the outer circumferential surface of the substrate 4 held by the mandrel 25. In this embodiment, even if spaces are provided between the inner circumferential surface of the guide body 32 and the outer circumferential surface 4*c* of the substrate 4 held by the mandrel 25, and between the inner circumferential surface of the guide body 32 and the outer circumferential surface of the mandrel 25, respectively, the second pressurized gas supplier 41 sends the pressurized gas therebetween to form the thin air film C so that the movement of the guide member 30 with respect to the mandrel 25 in the direction crossing the axis P is controlled or limited by the formed thin air film C. In this embodiment, as shown in FIG. 8, the mandrel 25 is twice or more in length than the substrate 4. When applying the coating material, the substrate 4 can be positioned in the guide members 30. The nozzle unit 17 follows a shape of the substrate 4 by the guide members 30 and the nozzle unit 17 follows an inclination of the mandrel 25 by the two guide members 30. Accordingly the nozzle unit 17 is adjusted corresponding to an outer profile of the substrate 4 so that the application can be performed while the substrate 4 and the nozzle unit 17 are maintained in a coaxial state.

According to this embodiment since the guide member 30 is disposed at a position where the inner circumferential surface of the guide member 30 faces the outer circumferential surface 4*c* of the substrate held by the mandrel 25 as the nozzle unit 17 is moved by the nozzle moving unit 18, the nozzle unit 17 can move along the outer shape of the substrate 4 by the guide member 30. Thereby, the coating film can be formed more firmly at an even thickness than when the nozzle unit 17 is guided by only the guide member 30 which slides on the mandrel 25.

Next, the film forming apparatus 1 according to a sixth embodiment of the present invention will be explained with reference to FIGS. 9 and 10. The same reference numbers are used for the same structures as those of the first to fifth embodiments and explanations about them are omitted.

Figure 9:
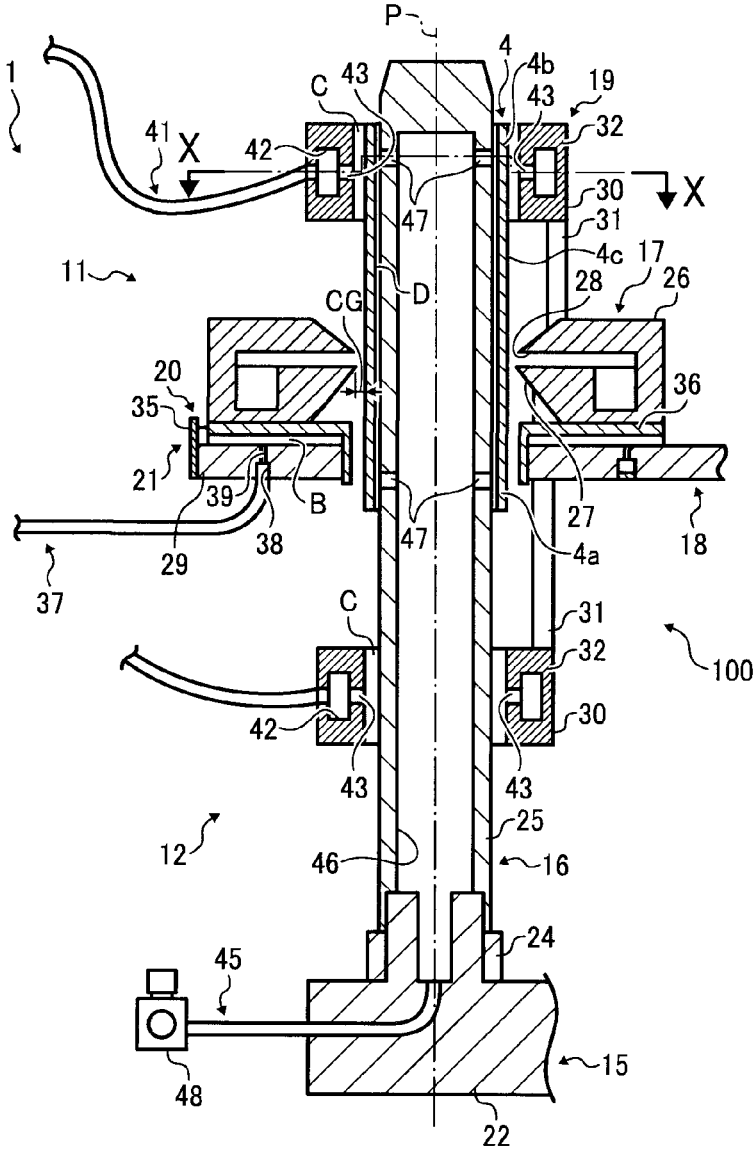
FIG. 9 is an explanatory view illustrating a schematic configuration of the film forming apparatus according to a sixth embodiment of the present invention.
Figure 10:
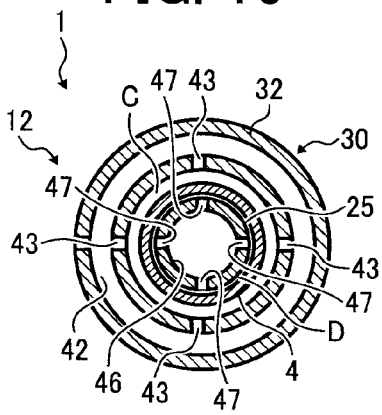
FIG. 10 is a sectional view along X-X line in FIG. 9

In this embodiment, the guide unit 100 of the film forming apparatus 1 includes a third pressurized gas supplier 45, as shown in FIGS. 9 and 10. The third pressurized gas supplier 45 includes a cylindrical hole 46, orifices 47, a supply source (not shown), and a regulator 48. The cylindrical hole 46 is provided in the mandrel 25 and is formed in a cylindrical form. The cylindrical hole 46 is provided in a coaxial state with the mandrel 25. The cylindrical hole 46 is connected to the regulator 48 via a tube.

The orifices 47 are provided at both end portions of the mandrel 29 in the direction of the axis P, that is to say, the orifices 47 are provided in two lines in the direction of the axis P of the mandrel 25. Each of the orifices 47 is opened at both sides of the cylindrical hole 46 and the outer circumferential surface of the mandrel 25. The orifices 47 provided on each of the end portions are provided with intervals to each other in the circumferential direction of the mandrel 26. In the illustrated example, four orifices 47 are provided with even intervals to each other in the circumferential direction of the mandrel 25. In the present invention, preferably four orifices 47 are provided in two or more lines in the direction of the axis P, and in each line, four, eight, or twelve orifices 47 are preferably provided in the circumferential direction of the mandrel 25. The regulator 48 adjusts a pressure of the pressurized gas supplied from the supply source to an inside of the cylindrical hole 46.

The aforementioned third pressurized gas supplier 45 sends the pressurized gas supplied from the supply source and the regulator 48 when applying the coating material between the outer circumferential surface of the mandrel 25 and the inner circumferential surface of the substrate 4 via the orifices 47 provided with the even intervals to each other in the circumferential direction. A thin air film D is formed between the mandrel 25 and the substrate 4 by blowing the pressurized gas from the outer circumferential surface of the mandrel 25. The third pressurized gas supplier 45 makes it possible to hold the substrate 4 in an accurate perfect circular state without being affected by fine concave and convex portions of the outer circumferential surface of the mandrel 25. In addition, the supplied pressure is adjustable in a range between 0.02 and 0.05 MPa by the regulator 48. The outer diameter Dm of the mandrel 25 is preferably slightly smaller than that of the inner diameter Dp of the substrate 4, and these diameters preferably have a relationship of $(Dp-Dm)/Dm=-0.0004$. In this embodiment, even if spaces are provided between the inner circumferential surface of the guide body 32 and the outer circumferential surface 4*c* of the substrate 4 held by the mandrel 25 and between the inner circumferential surface of the guide body 32 and the outer circumferential surface of the mandrel 25, respectively, the second pressurized gas supplier 41 sends the pressurized gas therebetween to form the thin air film C so that the movement of the guide member 30 of the nozzle guiding portion 19 in the direction crossing the axis P with respect to the mandrel 25 is controlled by the thin air film C.

In this embodiment, since the film forming apparatus 1 includes the third gas supply portion 45 which supplies the pressurized gas between the mandrel 25 and the substrate 4, the substrate 4 is held on the mandrel 25 by the pressurized gas. Accordingly, the substrate 4 can be held accurately in a cylindrical form so that the elastic layer 5 can be more firmly formed at an even thickness.

Next, the film forming apparatus 1 according to a seventh embodiment of the present invention will be explained with reference to FIG. 11. The same reference numbers are used for the same structures as those of the first to sixth embodiments and explanations about them are omitted.

Figure 11:
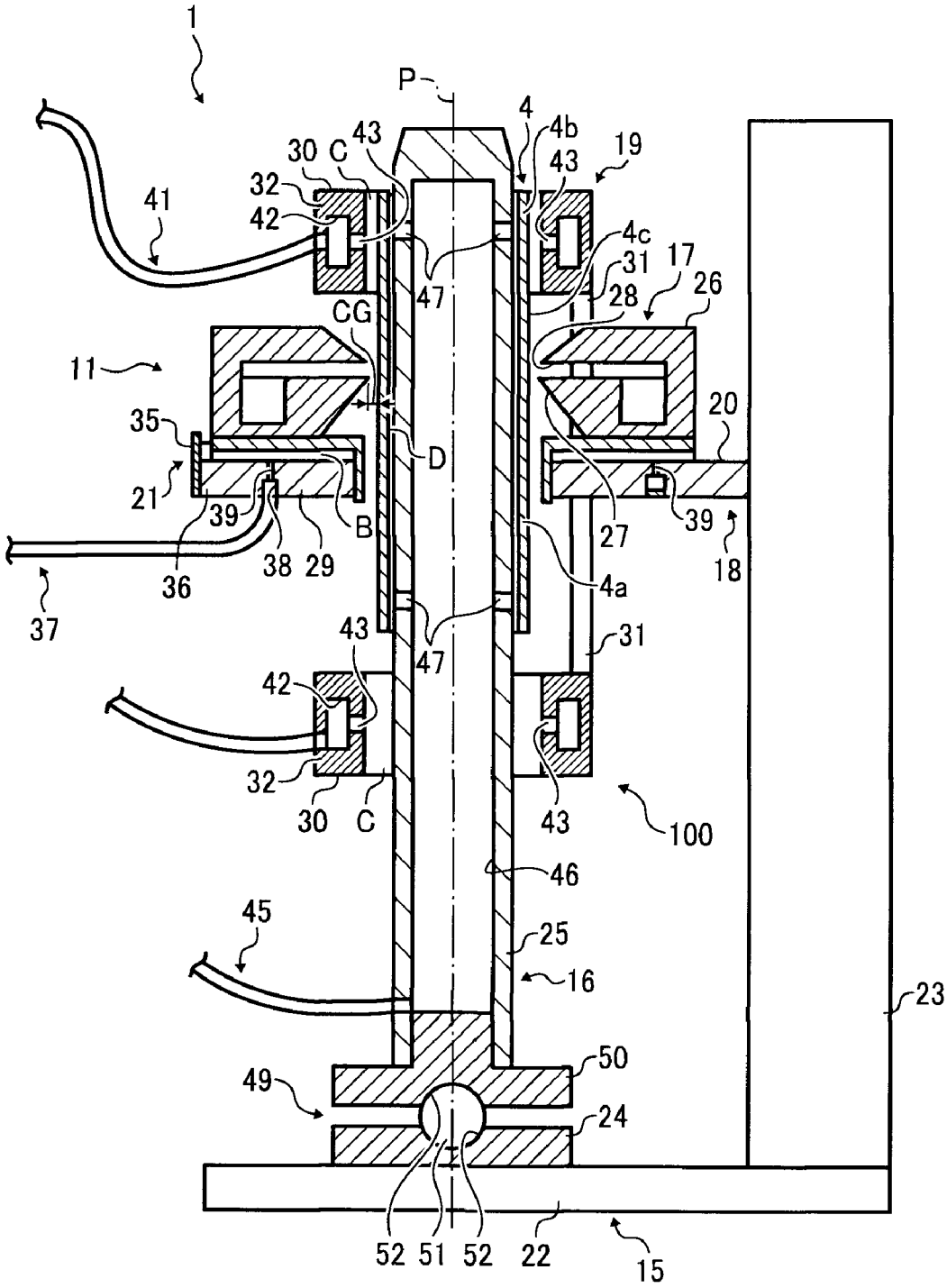
FIG. 11 is an explanatory view illustrating a schematic configuration of the film forming apparatus according to a seventh embodiment of the present invention.

In this embodiment, the film forming apparatus 1 includes a universal joint 49, as shown in FIG. 11. The universal joint 49 has a rockable base 50, and a ball 51 as a rolling element. The rockable base 50 is provided on the base 24. The ball 51 is provided between the rockable base 50 and the base 24. A concave portion 52 which is formed in a shape corresponding to an outer shape of the ball 61 so as to allow the ball 51 to roll in all directions, is provided on both of the rockable base 50 and the base 24. An end portion (lower end) of the mandrel 25 in the direction of the axis P is held by the rockable base 50.

Due to the universal joint 49, since the ball 51 rolls in all directions, the mandrel 25 is supported rockably in all directions about the end portion of the mandrel 25 in the direction of the axis P as a center with respect to the base 22. That is to say, the universal joint 49 can rockably move the mandrel in al directions about the end of the mandrel as a rocking center.

In this embodiment, the mandrel 25 is fixed on the rockable base 50 which is inclined at a slight angle with respect to a horizontal direction via the ball 51 so that the mandrel 25 is disposed inclinably with respect to the direction of the axis P. Thereby, when applying the coating material 7, an inclination of the mandrel 25 can follow the movement of the guide member 30 in the direction of the axis P. Since the nozzle moving unit 18 has a minute swell in the direction of the axis P, the mandrel 25 is constantly maintained to be disposed parallel to the swell of the nozzle moving unit 18 so that the aforementioned interval CG is maintained accurately constant.

Furthermore, in this embodiment, even if the spaces are disposed between the inner circumferential surface of the guide body 32 and the outer circumferential surface 4*c* of the substrate 4 held by the mandrel 25 and between the inner circumferential surface of the guide body 32 and the outer circumferential surface of the mandrel 25, respectively, the second pressurized gas supplier 41 sends the pressurized gas therebetween to form the thin air film C so that the movement of the guide member 30 in the direction crossing the axis P with respect to the mandrel 25 is controlled by the thin air film C.

In this embodiment, the film forming apparatus 1 includes the universal joint 49 through which the mandrel 25 can be disposed slightly rockably with respect to the axis P in any directions. Accordingly the mandrel 25 and the nozzle unit 17 can be maintained in the coaxial state without depending on accuracy of the nozzle moving unit 18 which moves the nozzle unit 17. Thereby, the elastic layer 5 as the coating film is formed more constantly at the even thickness so that the quality of the elastic layer 5 can be improved.

Although, in the aforementioned embodiments, the elastic layer 5 of the fixing belt 2 is formed as a coating film, the present invention is not limited thereto and the coating film can be formed on various endless belts. Although the coating film is formed on the fixing belt of an endless belt type in the aforementioned embodiments, the present invention can be applied in a fixing roller on which the coating film is formed by applying the coating material 7 on an outer circumferential surface of a cylindrical cored bar made of for example a metal.

In addition, although in the aforementioned embodiments the substrate 4 is fixed and the nozzle unit 17 is moved, it is possible that the nozzle unit 17 is fixed while the substrate 4 is moved, and that the nozzle unit 17 and the substrate 4 are moved. Furthermore, in the film forming apparatus 1 of the present invention, elements described in each of the aforementioned embodiments can be combined. Structures of each of the aforementioned pressurized gas suppliers 31, 41, and 45 and the universal joint 49 can be appropriately modified.

Although the present invention has been described in terms of exemplary embodiments, it is not limited thereto. It should be appreciated that variations may be made in the embodiments described by persons skilled in the art without departing from the scope of the present invention as defined by the following claims According to an embodiment of the present invention, the film forming apparatus includes the guide unit which is fixed on the nozzle unit to apply the coating material from outside in the circumferential direction on the outer circumferential surface of the object to be coated and the movement of the guide unit in the direction crossing the axis of the mandrel with respect to the object supporting device. Thereby, even when the nozzle unit moves with respect to the object supporting device, the nozzle unit follows the object supporting device via the guide unit so that the nozzle unit moves in the direction crossing the axis of the mandrel. Accordingly, when the nozzle unit moves along the axis with respect to the object supporting device, the nozzle unit and the object supporting device are maintained in the coaxial state. Therefore, if the nozzle unit is positioned at any position of the object supporting portion in the direction of the axis P, the interval between the outer circumferential surface of the object and the inner circumferential surface of the nozzle unit can be firmly maintained constant so that the coating film can be advantageously formed at the even thickness.

According to an embodiment of the present invention, the nozzle moving unit includes the first pressurized gas supplier which supplies the pressurized gas between the base member and the nozzle unit to form a thin air film of the pressurized gas between the nozzle unit and the base member. Thereby, the nozzle unit does not directly contact with the base member so that the nozzle unit can smoothly move in the direction crossing the axis of the base member, that is to say the object supporting member without being worn. Furthermore, the thin air film of the pressurized gas between the nozzle unit and the base member serves a function of removing oscillation generated when the nozzle unit moves along the axis so that unevenness of the coating film is prevented from occurring to improve the surface quality of the coating film.

According to an embodiment of the present invention, since the film forming apparatus includes the switching unit which determines whether the nozzle unit is fixed or is movably disposed on the base member, the nozzle unit can be fixed on the base member after and before applying the coating material. Accordingly, when the object is attached to and removed from the object supporting device, even if the guide unit is removed from the object supporting device, the guide unit can be attached to the object supporting device without interfering with the nozzle unit.

According to an embodiment of the present invention, the guide unit of the film forming apparatus includes the second pressurized gas supplier which supplies the pressurized gas between the inner circumferential surface of the guide member and the outer circumferential surface of the object supporting device to form the thin film of the pressurized gas between the guide member and the object supporting device. Accordingly, when the nozzle unit moves, the nozzle unit can be prevented from directly contacting with the object supporting device so that the nozzle unit and the object supporting device are prevented from being worn to achieve longer lasting of the film forming apparatus.

According to an embodiment of the present invention, the inner circumferential surface of the guide member is disposed so as to face the outer circumferential surface of the object held by the object supporting device. Thereby, the guide unit, that is to say, the nozzle unit can move along the form of the object so that the coating film can be formed more accurately at the even thickness than when the guide unit moves only along the outer circumferential surface of the object supporting device.

According to an embodiment of the present invention, since the plurality of guide members are provided with intervals to each other along the axis of the object supporting device, the object supporting device and the nozzle unit can be more firmly maintained in the coaxial state 80 that the coating film can be more firmly formed at the even thickness.

According to an embodiment of the present invention, the guide unit of the film forming apparatus includes the third pressurized gas supplier which supplies the pressurized gas between the object supporting device and the object. Thereby the object is held on the object supporting device by the pressurized gas so that the coating object can be held accurately in the cylindrical form without being affected by the concave and convex portions of the surface of the object supporting device. Accordingly, the coating film can be formed more firmly at the even thickness.

According to an embodiment of the present invention, the film forming apparatus has a rockably supporting portion which supports in a slightly rockable state in any directions about the end portion of the object supporting device as the center. Thereby, the object supporting device and the nozzle unit can be maintained in the coaxial state without depending on the accuracy of the nozzle moving unit which moves the nozzle unit. Accordingly, the coating film can be formed more constantly in the even thickness so that the quality of the coating film can be improved.

What is claimed is:

1. A film forming apparatus to form a coating film by applying a coating material to an outer circumferential surface of a cylindrical object to be coated, comprising:

a material applying device having a nozzle unit to apply the coating material to the outer circumferential surface of the cylindrical object and a material supplying unit to supply the coating material to the nozzle unit; and a moving device configured to move the nozzle unit relatively to the cylindrical object such that the coating material is applied uniformly to the outer circumferential surface of the cylindrical object, wherein the moving device includes an object holding unit configured to hold the cylindrical object, a nozzle moving unit configured to move relatively the nozzle unit with respect to the cylindrical object holding unit along a longitudinal axis of the object holding unit, and a guide unit configured to guide the nozzle unit along the object holding unit such that an interval between the nozzle unit and the cylindrical object is maintained constant as the nozzle unit moves along the object holding unit, wherein the guide unit includes a nozzle guiding portion which is fixed on the nozzle unit and movably disposed with respect to the object holding unit along the direction of the axis of the object holding unit, and wherein the guide unit further includes a nozzle carrying portion configured to carry and movably support the nozzle unit with respect to the nozzle moving unit in a direction perpendicular to the axis of the object holding unit.

2. The film forming apparatus according to claim 1, wherein the nozzle unit is formed in an annular form and has an inner circumferential surface disposed to face the outer circumferential surface of the cylindrical object with an interval.

3. The film forming apparatus according to claim 2, wherein the nozzle unit has a slit which is formed entirely on the inner circumferential surface of the nozzle unit and through which the coating material is applied.

4. The film forming apparatus according to claim 1, wherein the nozzle moving unit includes a base member on which the nozzle unit is disposed.

5. The film forming apparatus according to claim 4, wherein the nozzle carrying portion includes a plurality of rollers rollably disposed on the base member of the nozzle moving unit.

6. The film forming apparatus according to claim 4, wherein the nozzle carrying portion includes a first pressurized gas supplier configured to supply pressurized gas between the base member and the nozzle unit.

7. The film forming apparatus according to claim 6, wherein the nozzle guiding portion has a guide member which is formed in an annular form and the object holding unit is inserted in the nozzle guiding portion.

8. The film forming apparatus according to claim 7, wherein the guide unit includes a second pressurized gas supplier which supplies pressurized gas between an inner circumferential surface of the guide member and an outer circumferential surface of the object holding unit.

9. The film forming apparatus according to claim 8, wherein the guide member is provided at a position where the inner circumferential surface of the guide member faces the outer circumferential surface of the cylindrical object held by the object holding unit as the nozzle unit is moved by the nozzle moving unit.

10. The film forming apparatus according to claim 8, wherein the guide unit includes a third pressurized gas supplier which supplies pressurized gas between the object holding unit and an inner circumferential surface of the cylindrical object.

11. The film forming apparatus according to claim 4, further comprising a switching unit provided on the base member to switch between states in which movement of the nozzle unit with respect to the base member is allowed and is limited.

12. The film forming apparatus according to claim 1, wherein the nozzle guiding portion has a plurality of guide members which are provided with intervals to each other along the axis of the object holding unit.

13. The film forming apparatus according to claim 1, wherein the guide unit includes a universal joint configured to move rockably the object holding unit in all directions about an end of the object holding unit as a center.

* * * * *